US006627598B1

(12) United States Patent
Ingram et al.

(10) Patent No.: US 6,627,598 B1
(45) Date of Patent: Sep. 30, 2003

(54) SOLID DETERGENT COMPOSITIONS COMPRISING AN ORGANOPHILIC SMECTITE CLAY

(75) Inventors: Barry Thomas Ingram, Whitley Bay (GB); Stephen Wayne Heinzman, Whitley Bay (GB); Nathalie Sophie Letzelter, Newcastle upon Tyne (GB); Robin Gibson Hall, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/031,479

(22) PCT Filed: Jul. 14, 2000

(86) PCT No.: PCT/US00/19470

§ 371 (c)(1),
(2), (4) Date: Jan. 18, 2002

(87) PCT Pub. No.: WO01/07553

PCT Pub. Date: Feb. 1, 2001

(30) Foreign Application Priority Data

Jul. 22, 1999 (GB) ..... 9917162

(51) Int. Cl.[7] ..... C11D 3/08; C11D 3/37

(52) U.S. Cl. ..... 510/507; 510/276; 510/329; 510/330; 510/334; 510/485; 510/515

(58) Field of Search ..... 510/276, 329, 510/330, 334, 485, 507, 515

(56) References Cited

U.S. PATENT DOCUMENTS

| | | | | | |
|---|---|---|---|---|---|
| 4,764,292 | A | * | 8/1988 | Sepulveda et al. | 252/8.8 |
| 4,844,821 | A | * | 7/1989 | Mermelstein et al. | 252/8.7 |
| 4,846,992 | A | * | 7/1989 | Fonsny | 252/90 |
| 5,443,750 | A | * | 8/1995 | Convents et al. | 252/174.12 |

FOREIGN PATENT DOCUMENTS

| | | | |
|---|---|---|---|
| EP | 0 328 182 A2 | | 8/1989 |
| EP | 710713 | * | 10/1995 |
| EP | 0 710 713 A2 | | 5/1996 |
| WO | WO 00/60039 | | 10/2000 |
| WO | 00/60039 | * | 10/2000 |

* cited by examiner

*Primary Examiner*—Charles Boyer
(74) *Attorney, Agent, or Firm*—Julia A. Glazer; Brahm J. Corstanje; Kim W. Zerby

(57) ABSTRACT

The present invention relates to detergent compositions which comprise a flocculating agent and an organophilic smectite clay whereof at least 30%, preferably at least 40% of the exchangeable cations in the clay is replaced by one or more long-chain organic cations, preferably having at least one long carbon chain of at least 10 or even 12 carbon atoms. The compositions provide improved fabric softening and deliver good cleaning.

13 Claims, No Drawings

SOLID DETERGENT COMPOSITIONS COMPRISING AN ORGANOPHILIC SMECTITE CLAY

TECHNICAL FIELD

The present invention relates to detergent compositions which comprise an organophilic smectite clay which comprises one or more long-chain organic cations which have replaced some or all of the exchangeable cations of normal smectite clay.

BACKGROUND TO THE INVENTION

Various softening agent are known to have fabric conditioning or softening properties. They can be used in the form of fabric conditioners which are added during the rinse of the wash or incorporated in detergent compositions to provide softening during the wash itself.

Detergent compositions which comprise a softening agent have to provide excellent cleaning as well as softening. Detergents containing certain clays have been found to deliver good cleaning and softening. However, there is a desire to further improve the softening of such known detergent products.

Various alternatives are suggested in the art. For example, U.S. Pat. No. 4,764,292 suggest detergents containing quaternary ammonium softeners and organophilic clay material, present in the detergent in a ratio of 1:3 to 3:1.

It has been found that when such organophilic clay and quaternary ammonium softeners are used in detergents, the cleaning performance is reduced. Also, it has been found that the organophilic clays and quaternary ammonium softeners do not always provide sufficient softening to the fabrics.

It is believed that such quaternary ammonium softeners can have an adverse interaction with specific detergent actives, such as anionic surfactant and that this results in a reduced cleaning performance, which is not acceptable for the consumers.

The inventors have now found that when a hydrophilic clay flocculating agent is incorporated in detergent compositions comprising specific organophilic smectite clay good, softening and cleaning of the fabric is achieved. It is believed that the clay flocculating agent which can interact with normal hydrophilic clays, surprisingly also interact with the specific, more hydrophobic organophilic clays comprising specific long-chain organic cations. Without wishing to be bound by theory, it is believed that the flocculating agent not only aids the deposition onto the fabric of the specific organophilic clay, but it also reduces the interaction of the cations and other detergent actives, such as anionic surfactants. Thus, surprisingly improved softening is obtained, whilst a good cleaning performance of the detergent is maintained.

SUMMARY OF THE INVENTION

The invention relates to a detergent composition comprising a flocculating agent and an organophilic smectite clay whereof at least 30%, preferably at least 40% of the exchangeable cations is replaced by one or more long-chain organic cations which have at least one carbon chain of at least 10 carbon atoms.

The inventors also found that the cleaning performance and softening performance of the composition of the invention can be maximised when the ratio of flocculating agent to organophilic clay is preferably from 1:200 to 1:30 or even from 1:150 to 1:50.

Organophilic Smectite Clay

The compositions of the invention contain a smectite clay whereby at least 30% or even at least 40% or preferably at least 50% or even at least 60% of the exchangeable cations is replaced by a long-chain organic cations. Such clay will herein be referred to as organophilic or hydrophobic clay.

When used herein, a long-chain organic cation can be any compound which comprises at least one chain having at least 10 carbon atoms, preferably at least 12 carbon atoms, or in certain embodiments of the invention, at least 16 or even at least 18 carbon atoms. Preferred long-chain organic cations are described hereinafter.

For the purpose of the invention, it should be understood that the organophilic clays are formed prior to incorporation into the detergent composition. Thus, the cations, or part thereof, of the normal smectite clays are replaced by the long-chain organic cations to form the organophilic smectite clays herein, prior to further processing of the material to form the detergents of the invention.

When used herein, complexed long-chain organic cations refers to long-chain organic cations which replace the exchangeable cations the clay would normally contain.

The compositions herein may comprise additional long-chain organic cationic material or salts thereof, which are not in the form of a complex with clay. In one embodiment the detergent composition may be free of, or substantially free of, non-complexed long-chain organic cations.

Preferably, the organophilc clay is such that from 40%, or even 50% or even 60%, to 90% or even 95% or even 98% or preferably to 100% of exchangeable cations are replaced by one or more long-chain organic cations.

The organophilc smectite clay is preferably present in the detergent compositions of the invention at a level of from 0.05% to 40%, more preferably from 0.5% to 30%, most preferably from 2% to 20% by weight of the composition. For clarity, it is noted that the term clay mineral compound, as used herein, excludes sodium aluminosilicate zeolite builder compounds, which however, may be included in the compositions of the invention as optional components.

The weight ratio of organophilc clay to the flocculating polymer is preferably from 1000:1 to 1:1, more preferably from 500:1 to 1:1, most preferably from300:1 to 1:1, or even more preferably from 200:1 to 25:1, or even from 150:1 to 30:1 or in certain applications even from 80:1 to 40:1.

The term smectite clays herein includes both the clays in which aluminium oxide is present in a silicate lattice and the clays in which magnesium oxide is present in a silicate lattice. The organophilc clay herein may be an expandable clay having a layered clay structure which has the ability to be swell or expand on contact with water.

The smectite clays used to make the organophilic clays of the present invention are commercially available. Highly preferred are smectite clays, which can be used to prepare the organophilic clays herein, are for example as disclosed in the U.S. Pat. Nos. 3,862,058 3,948,790, 3,954,632 and 4,062,647 and EP-A-299,575 and EP-A-313,146.

Specific examples of suitable smectite clays to be used to make the organophilic clays herein, include those selected from the classes of the bentonites—also known as montmorillonites, hectorites, volchonskoites, nontronites, saponites and sauconites, particularly those having an alkali or alkaline earth metal ion within the crystal lattice structure. Preferably hectorites and montmorillonites are used herein; sodium or calcium montmorillonite and hectonite are particularly preferred to make the organophilic clays herein.

It is to be recognised that such smectite clays can comprise mixtures of the various discrete mineral entities. Such mixtures of the smectite minerals are suitable from use herein.

The organophilic clay is preferably in the form of a platelet or lath-shaped particle. Preferably the ratio of the width to the length of such a platelet is at least 1:2, preferably at least 1:4 or even at least 1:6 or even at least 1:8.

The organophilic clays can be made by any suitable method. For instance they can be prepared by making a slurry or dispersion of the untreated clay in a solvent, preferably water, together with a quantity of the appropriate long-chain organic cations, intended to be reacted or complexed with the clay, that is to provide the desired degree of ion exchange. The treated clay can then be separated from the liquor by known methods such as filtration or centrifuging. Preferred can be that the organophilc clays are made by replacing the exchangeable inorganic cations of smectite clay with the organic cations in an aqueous reactor and then drying and milling the resultant organophilic clay.

The cation exchange capacity of clays and the percentage of exchange of the cations with the long-chain organic cations can be measured in several ways known in the art, as for example fully set out in Grimshaw, The Chemistry and Physics of Clays, Interscience Publishers, Inc.,pp. 264–265 (1971).

The organophilc clay can be dry mixed with the other components of the detergent composition, or it may be dispersed or dissolved in water or other liquids, including for example liquid components of the detergent composition, e.g. the nonionic surfactant and than sprayed onto other detergent components or formed into a granule by any method of granulation, for example agglomeration, spray-drying, compaction and/ or extrusion, and then incorporated in the detergent compositions.

In a highly preferred embodiment of the invention, the organophilc clay is present in an intimate mixture or in a particle with a humectant and/or a hydrophobic compound, preferably a wax or oil, such as paraffin oil. Preferred humectants are organic compounds, including propylene glycol, ethylene glycol, dimers or trimers of glycol, most preferably glycerol. The particle is preferably an agglomerate. Alternatively, the particle may be such that the wax or oil and optionally the humectant form an encapsulate on the clay or alternatively, the clay be a encapsulate for the wax or oil and the humectant. It may be preferred that the particle comprises an organic salt or silica or silicate.

It may also or alternatively be preferred that the organophilic clay is mixed with one or more components which help dispersion of the clay into the wash water. Preferred may be that the organophilc clay is present as a mixture and/or is coated with surfactants and/or polymeric material, such as polymeric polycarboxylates, and optionally also mixed with other builders. Preferably, such a mixture is further processed in a spray-drying method or agglomeration method or extrusion method, to obtain a spray dried particle, agglomerate or extrudate, comprising the organophilic clay.

Highly preferred maybe that one or more fatty acids are present in the detergent composition, or even in a particle containing the organophilc clay. It has been found that this can provide further improved flocculation and/or improved softening of the fabrics.

It may be preferred that the flocculating agent is also comprised in the particle or granule comprising the clay.

It may also be preferred that the intimate mixture comprises a chelating agent or heavy metal ion sequestrants, described herein after.

Long-chain Organic Cations

The long-chain organic cations herein comprise at least one chain of at least 10 or even at least 12 or even at least 14 or even at least 16 or even at least 18 carbon atoms. It may be preferred that at least two of such long-chains are present in the cation.

Preferred cations are quaternary ammonium cations and immidazolinium cations of the above requirements.

Preferred organophilic clays herein clay are smectite clays, preferably hectorite clays and/or montmorillonite clays containing one or more organic cations of formulae:

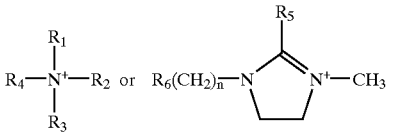

where $R_1$ represents an organic radical selected from $R_7$, $R_7$—CO—O—$(CH_2)_n$, or $R_7$—CO—$NR_8$— in which $R_7$ is an alkyl, alkenyl or alkylaryl group with 12–22 carbon atoms, whereby $R_8$ is hydrogen, $C_1$–$C_4$ alkyl, alkenyl or hydroxyalkyl, preferably —$CH_3$ or —$C_2H_5$ or —H; n is an integer, preferably equal to 2 or 3; $R_2$ represents an organic radical selected from $R_1$ or $C_1$–$C_4$ alkyl, alkenyl or hydroxyalkyl, preferably —$CH_3$ or —$CH_2CH_2OH$; $R_3$ and $R_4$ are organic radicals selected from $C_1$–$C_4$ alkyl-aryl, $C_1$–$C_4$ alkyl, alkenyl or hydroxyalkyl, preferably —$CH_3$, —$CH_2CH_2OH$, or benzyl group; $R_5$ is an alkyl or alkenyl group with 12–22 carbon atoms; $R_6$ is preferably —OH, —NHCO—$R_7$, or —OCO—$R_7$.

Highly preferred cations are quaternary ammonium cations having two $C_{16}$–$C_{28}$ or even $C_{16}$–$C_{24}$ alkyl chains. Highly preferred are one or more organic cations which have one or preferably two alkyl groups derived from natural fatty alcohols, the cations preferably being selected from dicocoyl methyl benzyl ammonium, dicocoyl ethyl benzyl ammonium, dicocoyl dimethyl ammonium, dicocoyl diethyl ammonium; more preferably ditallow diethyl ammonium, ditallow ethyl benzyl ammonium; more preferably ditallow dimethyl ammonium and/or ditallow methyl benzyl ammonium.

It may be highly preferred that mixtures of organic cations are present.

Preferably, the clay material is such that at least 80% or even 90% to 100% of the exchangeable cations are replaced by these preferred or highly preferred organic cations.

Highly preferred are organophilic clays as available from Rheox/Elementis, such as Bentone SD-1 and Bentone SD-3, which are registered trademarks of Rheox/Elementis.

Flocculating Agent

The compositions of the invention may contain a clay flocculating agent, preferably present at a level of from 0.005% to 10%, more preferably from 0.01% to 5%, most preferably from 0.05% or even 0.1% to 1% by weight of the composition.

Preferred as clay flocculating agents herein are organic polymeric materials having an average weight of from 100,000 to 10,000,000, preferably from 150,000 to 5,000,000, more preferably from 200,000 to 2,000,000.

Suitable organic polymeric materials comprise homopolymers or copolymers containing monomeric units selected from alkylene oxide, particularly ethylene oxide, acrylamide, acrylic acid, vinyl alcohol, vinyl pyrrolidone, and ethylene imine. Homopolymers of, on particular, ethylene oxide, but also acrylamide and acrylic acid are preferred.

European Patents No.s EP-A-299,575 and EP-A-313,146 in the name of the Procter and Gamble Company describe preferred organic polymeric clay flocculating agents for use herein.

Highly preferred are polyethylene oxides of an average molecular weight from 150,000 to 3,000,000.

Inorganic clay flocculating agents are also suitable herein, typical examples of which include lime and alum.

The flocculating agent is preferably present in a detergent base granule such as a detergent agglomerate, extrudate or spray-dried particle, comprising generally one or more surfactants and builders.

Detergent Compositions

The compositions of the invention can be liquid compositions, but preferably they are solid, in the form of granules, extrudates, flakes, bars or tablets.

The compositions can be used in automatic washing or hand washing. Also, the compositions can be such that they are suitable for pre-treatment or soaking, or for conditioning of the fabric after the main wash.

The compositions in accord with the invention contains additional detergent actives. The precise nature of these additional components, and levels of incorporation thereof will depend on the physical form of the composition or component, and the precise nature of the washing operation for which it is to be used.

The compositions of the invention preferably contain one or more additional detergent components selected from surfactants, bleaches, bleach catalysts, alkalinity systems, builders, additional organic polymeric compounds, enzymes, suds suppressers, lime soap, dispersants, perfumes, brighteners, photo-bleaching agents, corrosion inhibitors, soil release polymers, cellulose based polymers, including carboxy methyl cellulose, cellulose ethers or ester or amine or amide modified celluloses, dispensing aids such as water-swellable polymers and effervescence sources, preferably based on carbonate and acid compounds, in particular citric acid, malic acid or maleic acid, dye transfer inhibitors, and process aids such as hydrotropes. These ingredients are described in more detail herein.

It may be preferred that additional softening agents are present. For example, it may be preferred that nonionic softening agents, additional (non organophilic) clay softening agents, and/or silicone derivative softeners are present in the invention.

Highly preferred are one or more anionic surfactants, as described herein after, preferably present at a level of 1–50% by weight or even 3 to 25% by weight.

Highly preferred are perfume components, preferably at least one component comprising a coating agent and/or carrier material, preferably an encapsulate of preferably starch or other cellulosic material. The inventors have found that the perfumes are more efficiently deposited onto the fabric in the compositions of the invention, comprising the organophilic clay and preferably a flocculating agent.

It may also be preferred that the composition herein comprises one or more cationic surfactants, which are not complexed with the clay herein, preferably at a level of from 0.1% or even 0.5% to about 5% by weight. It may be beneficial that they are not comprised in the same particle as the organophilic clays herein.

Anionic Surfactant

The detergent compositions of the invention comprise at least 1% by weight of the composition of an anionic surfactant. More preferably the anionic surfactant is present at a level of from 3% to 40%, more preferably from 3% or even 5% to 25% by weight of the composition.

Any anionic surfactant useful for detersive purposes is suitable. These can include salts (including, for example, sodium, potassium, ammonium, and substituted ammonium salts such as mono-, di- and triethanolamine salts) of the anionic sulfate, sulfonate, carboxylate and sarcosinate surfactants.

Anionic sulfonates surfactants are preferably present as the anionic surfactant or part of the anionic surfactants.

Preferred amounts of the alkyl sulfate surfactant, including preferably branched alkyl sulphates, are from 0% to 25%, or more preferably 2% to 20%, or even 4% to 12% by weight of the detergent composition. Preferred amounts of the sulfonate surfactant, preferably the alkyl benzene sulfonate surfactant in the detergent composition are from at least 3%, preferably at least 5%, or even at least 8% or even at least 10% by weight, preferably up to 30% by weight.

Anionic Sulfate Surfactant

Anionic sulfate surfactants suitable for use in the compositions or components of the invention include the primary and secondary alkyl sulfates, having a linear or branched alkyl or alkenyl moiety having from 9 to 22 carbon atoms or more preferably $C_{12}$ to $C_{18}$ alkyl; alkyl ethoxysulfates; fatty oleoyl glycerol sulfates; alkyl phenol ethylene oxide ether sulfates; the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl ethoxysulfate surfactants are preferably selected from the group consisting of the $C_9$–$C_{22}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of a $C_5$–$C_{20}$, more preferably a $C_{10}$–$C_{16}$, more preferably a $C_{11}$–$C_{13}$ (linear) alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

The alkyl ester sulfonated surfactant are preferably of the formula $$R^1—CH(SO_3M)—(A)_x—C(O)—OR^2$$

wherein $R^1$ is a $C_6$–$C_{22}$ hydrocarbyl, $R^2$ is a $C_1$–$C_6$ alkyl, A is a $C_6$–$C_{22}$ alkylene, alkenylene, x is 0 or 1, and M is a cation. The counterion M is preferably sodium, potassium or ammonium.

The alkyl ester sulfonated surfactant is preferably a α-sulpho alkyl ester of the formula above, whereby thus x is 0. Preferably, $R^1$ is an alkyl or alkenyl group of from 10 to 22, preferably 16 C atoms and x is preferably 0. $R^2$ is preferably ethyl or more preferably methyl.

It can be preferred that the R1 of the ester is derived from unsaturated fatty acids, with preferably 1, 2 or 3 double bonds. It can also be preferred that $R^1$ of the ester is derived from a natural occurring fatty acid, preferably palmic acid or stearic acid or mixtures thereof.

Mid-chain Branched Alkyl Sulfates or Sulphonates

Mid-chain branched alkyl sulfates or sulphonates are also suitable anionic surfactants for use in the compositions or components of the inevntion. Preferred are the mid-chain branched alkyl sulfates.

Preferred mid-chain branched primary alkyl sulfate surfactants are of the formula

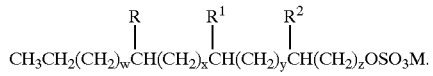

$$CH_3CH_2(CH_2)_wCH(R)(CH_2)_xCH(R^1)(CH_2)_yCH(R^2)(CH_2)_zOSO_3M.$$

These surfactants have a linear primary alkyl sulfate chain backbone (i.e., the longest linear carbon chain which includes the sulfated carbon atom) which preferably comprises from 12 to 19 carbon atoms and their branched primary alkyl moieties comprise preferably a total of at least 14 and preferably no more than 20, carbon atoms. In compositions or components thereof of the invention comprising more than one of these sulfate surfactants, the average total number of carbon atoms for the branched primary alkyl moieties is preferably within the range of from greater than 14.5 to about 17.5. Thus, the surfactant system preferably comprises at least one branched primary alkyl sulfate surfactant compound having a longest linear carbon chain of not less than 12 carbon atoms or not more than 19 carbon atoms, and the total number of carbon atoms including branching must be at least 14, and further the average total number of carbon atoms for the branched primary alkyl moiety is within the range of greater than 14.5 to about 17.5.

Preferred mono-methyl branched primary alkyl sulfates are selected from the group consisting of: 3-methyl pentadecanol sulfate, 4-methyl pentadecanol sulfate, 5-methyl pentadecanol sulfate, 6-methyl pentadecanol sulfate, 7-methyl pentadecanol sulfate, 8-methyl pentadecanol sulfate, 9-methyl pentadecanol sulfate, 10-methyl pentadecanol sulfate, 11-methyl pentadecanol sulfate, 12-methyl pentadecanol sulfate, 13-methyl pentadecanol sulfate, 3-methyl hexadecanol sulfate, 4-methyl hexadecanol sulfate, 5-methyl hexadecanol sulfate, 6-methyl hexadecanol sulfate, 7-methyl hexadecanol sulfate, 8-methyl hexadecanol sulfate, 9-methyl hexadecanol sulfate, 10-methyl hexadecanol sulfate, 11-methyl hexadecanol sulfate, 12-methyl hexadecanol sulfate, 13-methyl hexadecanol sulfate, 14-methyl hexadecanol sulfate, and mixtures thereof.

Preferred di-methyl branched primary alkyl sulfates are selected from the group consisting of: 2,3-methyl tetradecanol sulfate, 2,4-methyl tetradecanol sulfate, 2,5-methyl tetradecanol sulfate, 2,6-methyl tetradecanol sulfate, 2,7-methyl tetradecanol sulfate, 2,8-methyl tetradecanol sulfate, 2,9-methyl tetradecanol sulfate, 2,10-methyl tetecanol sulfate, 2,11-methyl tetradecanol sulfate, 2,12-methyl tetradecanol sulfate, 2,3-methyl pentadecanol sulfate, 2,4-methyl pentadecanol sulfate, 2,5-methyl pentadecanol sulfate, 2,6-methyl pentadecanol sulfate, 2,7-methyl pentadecanol sulfate, 2,8-methyl pentadecanol sulfate, 2,9-methyl pentadecanol sulfate, 2,10-methyl pentadecanol sulfate, 2,11-methyl pentadecanol sulfate, 2,12-methyl pentadecanol sulfate, 2,13-methyl pentadecanol sulfate, and mixtures thereof.

Nonionic Surfactant System

The detergent composition may also comprise a nonionic surfactant system comprising at least two nonionic alkoxylated surfactants.

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic alkoxylated fatty acid amides, nonionic ethoxylated/propoxylated fatty alcohols, nonionic ethoxylate/propoxylate condensates with propylene glycol, and the nonionic ethoxylate condensation products with propylene oxide/ethylene diamine adducts.

Preferably, at least one of the nonionic surfactants is an alkoxylated alcohol surfactant as described herein after.

Also, preferred are nonionic alkoxylated fatty acid amides, which can provide even more additional softening to the fabric, or to the skin when the detergent is in contact with the skin.

Most preferred is a nonionic surfactant system which comprises at least two nonionic alkoxylated alcohol surfactants whereof preferably one surfactant has an average alkoxylation degree of 5 or less and one surfactant has an average alkoxylation degree of more than 5. Highly preferred are systems comprising at least a nonionic alkoxylated alcohol with an average alkoxylation degree of 3 or 5 and at least one nonionic alkoxylated alcohol having an average alkoxylation degree of from 7 to 15, preferably 7 or 9.

The nonionic surfactant system is preferably present at a level of 0.5% to 35% or even 25% by weight, preferably from 2% to 15% or even 10% by weight and more preferably from 5% to 15% or even 10% by weight or even from 6% to 15% or even 10% by weight.

The alkoxylation groups of the nonionic surfactants preferably are propoxylate groups, more preferably ethoxylate groups.

The condensation products of aliphatic alcohols with from 1 to 25 moles of alkylene oxide, particularly ethylene oxide and/or propylene oxide, are preferred in the nonionic surfactant system herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms.

The nonioninc surfactant system of the invention may comprise an alkoxylated fatty acid amide, which comprises preferably a compound of the formula

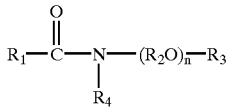

$$R_1-C(=O)-N(R_4)-(R_2O)_n-R_3$$

wherein $R_1$ is a $C_{12}$–$C_{18}$ alkyl or alkenyl group, $R_2$ is a $C_2$–$C_4$ alkylene group, $R_3$ is a hydrogen or a $C_1$–$C_4$ alkyl group, $R_4$ is a $C_1$–$C_4$ alkyl group or hydrogen and n is a number from 3 to 12.

The detergent compositions herein may also comprise additionally alkyl-polysaccharides, such as are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10}$–$C_{18}$ acylamido alkyl dimethylamine oxide.

A suitable example of an alkyl aphodicarboxylic acid is Miranol(TM) C2M Conc. manufactured by Miranol, Inc., Dayton, N.J.

Zwitterionic Surfactant

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein. Preferred betaines are $C_{12}$–$C_{18}$ dimethyl-ammonio hexanoate and the $C_{10}$–$C_{18}$ acylamidopropane (or ethane) dimethyl (or diethyl) betaines. Complex betaine surfactants are also suitable for use herein.

Cationic Surfactants

The compositions of the invention may comprise additional cationic compounds which are not in the form of a complex with smectite clays. Suitable cationic surfactants to be used as additional compounds in the detergent herein include the quaternary ammonium surfactants, which can have up to 26 carbon atoms Preferably the quaternary ammonium surfactant is a mono $C_6$–$C_{16}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4,228,042, 4,239,660 and 4,260,529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example $—CH_2—O—CH_2—$ and $—CH_2—NH—CH_2—$ linkages are included. In a preferred aspect the spacer group chain comprises only carbon atoms, most preferably the chain is a hydrocarbyl chain.

Cationic Mono-alkoxylated Amine Surfactants

Highly preferred herein are cationic mono-alkoxylated amine surfactant preferably of the general formula I:

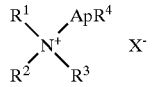

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are $—CH_2CH_2OH$, $—CH_2CH_2CH_2OH$, $—CH_2CH(CH_3)OH$ and $—CH(CH_3)CH_2OH$, with $—CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

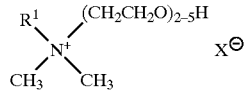

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent compositions of the invention is preferably from 0.1% to 20%, more preferably from 0.2% to 7%, most preferably from 0.3% to 3.0% by weight of the composition.

Cationic Bis-alkoxylated Amine Surfactant

The cationic bis-alkoxylated amine surfactant preferably has the general formula II:

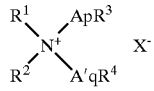

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof; p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

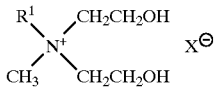

wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

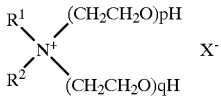

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Perhydrate Bleaches

An preferred additional components of the compositions is a perhydrate bleach, such as metal perborates and percarbonates, particularly the sodium salts. Perborate can be mono or tetra hydrated. They may be coated with known coating agents.

Potassium peroxymonopersulfate, sodium per is another optional inorganic perhydrate salt of use in the detergent compositions herein.

Organic Peroxyacid Bleaching System

A preferred feature of the composition is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. The TAED is preferably not present in the agglomerated particle of the present invention, but preferably present in the detergent composition, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide substituted alkyl peroxyacid precursor compounds are suitable herein, including those of the following general formulae:

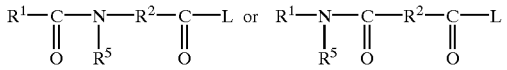

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Water-Soluble Builder Compound

The compositions in accord with the present invention preferably contain a water-soluble builder compound, typically present in detergent compositions at a level of from 1% to 80% by weight, preferably from 10% to 60% by weight, most preferably from 15% to 40% by weight of the composition.

The detergent compositions of the invention may comprise phosphate-containing builder material. Preferably present at a level of from 0.5% to 60%, more preferably from 5% to 50%, more preferably from 8% to 40.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The compositions in accord with the present invention may contain a partially soluble or insoluble builder compound, typically present in detergent compositions at a level of from 0.5% to 60% by weight, preferably from 5% to 50% by weight, most preferably from 8% to 40% weight of the composition.

Preferred are aluminosilicates and/or crystalline layered silicates such as SKS-6, available from Clariant.

Suitable aluminosilicate zeolites have the unit cell formula $Na_Z[(AlO_2)_Z(SiO_2)y].xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS, Zeolite MAP and mixtures thereof.

Heavy Metal Ion Sequestrant or Chelants

The compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions or component Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta(methylene phosphonate), ethylene diamine tri (methylene phosphonate)hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1hydroxyethane diphosphonic acid or the alkali metal, alkaline earth metal, ammonium, or substituted ammonium salts thereof, or mixtures thereof.

Enzyme

Another preferred ingredient useful in the compositions herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/ US 9703635, and in WO95/26397 and WO96/23873.

Amylase enzyme may be incorporated into the composition in accordance with the invention at a level of from 0.0001% to 2% active enzyme by weight of the composition.

Additional Organic Polymeric Compound

Organic polymeric compounds are preferred additional components of the compositions herein and are preferably present as components of any particulate components where they may act such as to bind the particulate component together. By organic polymeric compound it is meant herein essentially any polymeric organic compound commonly used as dispersants, and anti-redeposition and soil suspension agents in detergent composition.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

Other organic polymeric compounds suitable for incorporation in the detergent compositions herein include cellulose derivatives such as methylcellulose, carboxymethylcellulose, hydroxypropylmethylcellulose and hydroxyethylcellulose.

Polymeric Soil Release Agent

Polymeric soil release agents, hereinafter "SRA", can optionally be employed in the present compositions. If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat, No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK. Also highly preferred are polysaccheride polymers.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.;

Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application No.60/051517.

Another organic compound, which is a preferred clay dispersant/ anti-redeposition agent, for use herein, can be the ethoxylated cationic monoamines and diamines of the formula:

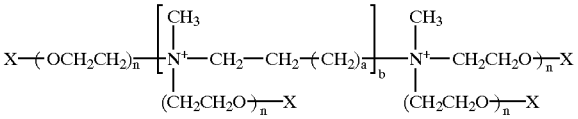

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. Nos. 4,659,802 and 4,664,848.

Suds Suppressing System

The detergent compositions of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Polymeric Dye Transfer Inhibiting Agents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The compositions herein also optionally contain from about 0.005% to 5% by weight of certain types of hydrophilic optical brighteners.

Preferred brighteners include 4,4',-bis[(4-anilino-6-(N-2-bis-hydroxyethyl)-s-triazine-2-yl)amino]-2,2'-stilbenedisulfonic acid and disodium salt, commercially marketed under the tradename Tinopal-UNPA-GX by Ciba-Geigy Corporation; 4,4'-bis[(4-anilino-6-(N-2-hydroxyethyl-N-methylamino)-s-triazine-2-yl)amino]2,2'-stilbenedisulfonic acid disodium salt, commercially marketed under the tradename Tinopal 5BM-GX by Ciba-Geigy Corporation; 4,4'-bis[(4-anilino-6-morphilino-s-triazine-2-yl)amino]2,2'-stilbenedisulfonic acid, sodium salt, commercially marketed under the tradename Tinopal-DMS-X and Tinopal AMS-GX by Ciba Geigy Corporation.

Other Optional Ingredients

Other optional ingredients suitable for inclusion in the compositions of the invention include perfumes, in particular including encapsulated perfumes, the perfume oils preferably being present at a level of from 0.01% or even 0.05% or even 0.1% by weight of the composition.

Highly preferred compositions contain from about 2% to about 10% by weight of an organic acid, preferably citric acid, malic acid, maleic acid, acetic acid, tartaric acid, glutaric acid or an aminoacid.

Also preferred may be neutralizing agents, buffering agents, phase regulants, hydrotropes, enzyme stabilizing agents, polyacids, suds regulants, opacifiers, anti-oxidants, bactericides, photo-bleaches, speckles, dyes, such as those described in U.S. Pat. No. 4,285,841 to Barrat et al., issued Aug. 25, 1981 (herein incorporated by reference).

The compositions herein can take a variety of physical forms including liquid, but preferably solid forms such as tablet, flake, pastille and bar, and preferably granular forms. Solid composition of the invention can be made via a variety of methods, including dry-mixing, agglomerating, compaction, or spray-drying of the various compounds comprised in the detergent component, or mixtures of these techniques.

The compositions in accord with the present invention can also be used in or in combination with bleach additive compositions, for example comprising chlorine bleach.

Detergent compositions herein, in particular laundry detergents, preferably have a bulk density of from 280 g/liter to 2000 g/liter, or preferably from 300 g/liter or even 350 g/liter or 420 g/liter to 1500 g/liter or more preferably to 1000 g/liter or even to 700 g/liter.

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liters, as are typical product dosages and wash solution volumes commonly employed in conventional machine laundry methods.

The compositions herein can be useful in both conventional washing machines and low-water fill washing machines.

In a preferred use aspect the composition hand washing. In another preferred aspect the detergent composition is a pre-treatment or soaking composition, to be used to pre-treat or soak soiled and stained fabrics.

Abbreviations Used in Examples

In the detergent compositions, the abbreviated component identifications have the following meanings:

| | |
|---|---|
| LAS | Sodium linear $C_{11-13}$ alkyl benzene sulfonate |
| TAS | Sodium tallow alkyl sulfate |
| CxyAS | Sodium $C_{1x}$–$C_{1y}$ alkyl sulfate |
| CxyEzS | Sodium $C_{1x}$–$C_{1y}$ alkyl sulfate condensed with z moles of ethylene oxide |
| CxyEz | $C_{1x}$–$C_{1y}$ predominantly linear primary alcohol condensed with an average of z moles of ethylene oxide |
| QAS | $R_2.N^+(CH_3)_2(C_2H_4OH)$ with $R_2 = C_{12}$–$C_{14}$ |
| QAS 1 | $R_2.N^+(CH_3)_2(C_2H_4OH)$ with $R_2 = C_8$–$C_{11}$ |
| MBAS | Branched C16–C18 alkylsulphate having an average methyl branching of 1.5 |
| MES | x-sulpho methylester of $C_{18}$ fatty acid |
| APA | $C_8$–$C_{10}$ amido propyl dimethyl amine |
| Soap | Sodium linear alkyl carboxylate derived from an 80/20 mixture of tallow and coconut fatty acids |
| STS | Sodium toluene sulphonate |
| CFAA | $C_{12}$–$C_{14}$ (coco) alkyl N-methyl glucamide |
| TFAA | $C_{16}$–$C_{18}$ alkyl N-methyl glucamide |
| TPKFA | $C_{16}$–$C_{18}$ topped whole cut fatty acids |
| STPP | Anhydrous sodium tripolyphosphate |
| TSPP | Tetrasodium pyrophosphate |
| Zeolite A | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |
| NaSKS-6 | Crystalline layered silicate of formula $\delta$-$Na_2Si_2O_5$ |
| Citric acid | Anhydrous citric acid |
| Borate | Sodium borate |
| Carbonate | Anhydrous sodium carbonate with a particle size between 200 $\mu$m and 900 $\mu$m |
| Bicarbonate | Anhydrous sodium bicarbonate with a particle size distribution between 400 $\mu$m and 1200 $\mu$m |
| Silicate | Amorphous sodium silicate ($SiO_2$:$Na_2O$ = 2.0:1) |
| Sulfate | Anhydrous sodium sulfate |

-continued

| | |
|---|---|
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease 1 | Proteolytic enzyme, having 4% by weight of active enzyme, as described in WO 95/10591, sold by Genencor Int. Inc. |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Amylase 11 | Amylolytic enzyme, as disclosed in PCT/US9703635 |
| Lipase | Lipolytic enzyme, having 2.0% by weight of active enzyme, sold by NOVO Industries A/S under the tradename Lipolase or Lipolase Ultra |
| PB4 | Sodium perborate tetrahydrate of nominal formula $NaBO_2.3H_2O.H_2O$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| DOBS | Decanoyl oxybenzene sulfonate in the form of the sodium salt |
| NOBS | Nonanoyloxybenzene sulfonate in the form of the sodium salt |
| NACA-OBS | (6-nonamidocaproyl) oxybenzene sulfonate |
| DOBA | Decanoyl oxybenzoic acid |
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| HEDP | 1,1-hydroxyethane diphosphonic acid |
| Photoactivated bleach | Sulfonated zinc phthlocyanine encapsulated in dextrin soluble polymer |
| Brightener | Disodium 4,4'-bis(2-sulphostyryl)biphenyl or Disodium 4,4'-bis(4-anilino-6-morpholino-1.3.5-triazin-2-yl)amino) stilbene-2:2'-disulfonate |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | $bis((C_2H_5O)(C_2H_4O)_n)(CH_3)\text{-}N^+\text{-}C_6H_{12}\text{-}N^+\text{-}(CH_3)$ $bis((C_2H_5O)\text{-}(C_2H_4O))_n$, wherein n = from 20 to 30 |
| PEI | Polyethyleneimine with an average molecular weight of 1800 and an average ethoxylation degree of 7 ethyleneoxy residues per nitrogen |
| Clay I | Bentone SD-1, as available from Rheox/Elementis |
| Clay II | Bentone SD-3, as available from Rheox/Elementis |
| Flocculating agent I | polyethylene oxide of average molecular weight of between 200,000 and 400,000 |
| Flocculating agent II | polyethylene oxide of average molecular weight of between 400,000 and 1,000,000 |
| Flocculating agent III | polymer of acrylamide and/or acrylic acid of average molecular weight of 200,000 and 400,000 |
| SRP I | Anionically or nonionically end-capped polyester soil release polymer |
| Silicone antifoam | Polydimethylsiloxane foam controller with siloxane-oxyalkylene copolymer as dispersing agent with a ratio of said foam controller to said dispersing agent of 10:1 to 100:1 |
| wax | Paraffin wax |
| Speckle | Coloured carbonate salt or organic carboxylic acid/salt |

In the following examples all levels are quoted as % by weight of the composition:

EXAMPLE 1

The following detergent formulations are in accord with the invention.

| | A | B | C | D |
|---|---|---|---|---|
| Base granule | | | | |
| Clay I or II | 7.0 | — | — | — |
| Flocculating agent I or II | 0.1 | 0.5 | 0.2 | 0.1 |
| LAS | 16.0 | 10.0 | 11.0 | 7.0 |
| TAS | — | 3.0 | — | — |
| QAS | — | 0.4 | 1.0 | 2.0 |
| Zeolite A | — | 20.0 | — | 16.0 |
| STPP | 24.0 | — | 14.0 | — |
| Sulfate | — | 12.0 | — | 3.0 |
| MA/AA | — | 2.0 | 1.0 | 1.0 |
| Silicate | 4.0 | — | 3.0 | — |
| CMC | 1.0 | — | 0.5 | 0.2 |
| Brightener | 0.2 | 0.05 | 0.01 | 0.01 |
| Sodium carbonate | 10.0 | 6.0 | 10.0 | 5.0 |
| DTPMP | 0.4 | 0.4 | 0.2 | — |
| Spray on | | | | |
| Brightener | 0.02 | — | — | 0.02 |
| C45E7 or E9 | — | — | 2.0 | 1.0 |
| C45E3 or E4 | — | — | 2.0 | 4.0 |
| Perfume | 0.5 | — | 0.5 | 0.2 |
| Silicone antifoam | 0.3 | — | — | — |
| Dry additives | | | | |
| Clay I or II | | 14.0 | 5.0 | 10.0 |
| HEDP/EDDS | 0.3 | — | — | 0.5 |
| Sulfate | 12.0 | — | — | 10.0 |
| Carbonate | 10.0 | — | 15.0 | 10.0 |
| Citric acid | 2.5 | — | — | 2.0 |
| SKS-6 | 3.5 | — | — | 5.0 |
| Percarbonate | — | — | 9.0 | — |
| PB4 | — | — | — | 4.0 |
| NOBS | — | — | 1.3 | — |
| TAED | — | — | 2.0 | 1.5 |
| Protease | 1.0 | 1.0 | 1.0 | 1.0 |
| Cellulase | — | 0.4 | — | 0.1 |
| Amylase | 0.2 | 0.2 | 0.2 | 0.2 |
| Brightener | 0.05 | — | — | 0.05 |
| Perfumes (including encapsulated) | 1.0 | 0.2 | 1.5 | 1.3 |
| Speckle | 1.2 | 0.5 | 2.0 | — |
| Misc/minor to 100% | | | | |

EXAMPLE 2

The following granular detergent formulations are in accord with the invention.

| | E | F | G | H | I | J |
|---|---|---|---|---|---|---|
| Blown powder | | | | | | |
| LAS | 23.0 | 8.0 | 7.0 | 9.0 | — | 7.0 |
| QAS | — | — | — | 0.9 | 1.0 | — |
| MBAS | — | 6.0 | 5.0 | — | 10.0 | — |
| C45AE3S | — | 1.0 | 1.0 | 1.0 | — | — |
| MES | — | — | — | — | 2.0 | 4.0 |
| STPP/Zeolite A | 10.0 | 18.0 | 18.0 | 20.0 | 10.0 | 10.0 |
| MA/AA | — | 0.5 | — | — | — | 2.0 |
| MA/AA (1) | 7.0 | — | — | — | — | — |
| AA | — | 3.0 | 3.0 | 2.0 | 3.0 | 3.0 |
| Sulfate | 2.0 | 6.0 | 1.0 | — | — | — |
| Silicate | 10.0 | — | 2.0 | 7.0 | 1.0 | 1.0 |
| Carbonate | 25.0 | 0.8 | 10.0 | 5.0 | 14.0 | — |
| PEG 4000 | 0.4 | 1.5 | 1.5 | 1.0 | 1.0 | 1.0 |
| DTPA | — | 0.9 | 0.5 | — | — | 0.5 |
| Brightener | 0.3 | 0.2 | 0.3 | — | 0.1 | 0.3 |
| Flocculating agent I or III | 0.5 | 0.1 | 0.2 | 0.1 | 0.15 | 0.2 |
| Spray on | | | | | | |
| Clay I or II | — | — | 3.0 | — | — | — |
| brightner | — | 0.01 | 0.01 | 0.4 | — | — |
| C45E7 | — | 2.0 | 2.0 | — | 2.0 | 2.0 |
| C25E9 | 3.0 | — | — | — | — | — |
| C23E5 | — | — | 1.5 | 2.0 | — | 2.0 |
| Perfume | 0.3 | 0.3 | 0.3 | 2.0 | 0.3 | 0.3 |
| Agglomerates | | | | | | |
| C45AS | — | 5.0 | 5.0 | 2.0 | — | 5.0 |
| LAS | — | 2.0 | 2.0 | — | — | 2.0 |
| STPP/Zeolite A | — | 7.5 | 7.5 | 8.0 | — | 7.5 |
| Carbonate | — | 4.0 | 4.0 | 5.0 | — | 4.0 |
| PEG 4000 | — | 0.5 | 0.5 | — | — | 0.5 |
| Misc (water etc) | — | 2.0 | 2.0 | 2.0 | — | 2.0 |
| Agglomerate | | | | | | |
| Clay I or II | 10.0 | 4.0 | 3.0 | 15.0 | 7.0 | 6.0 |
| Wax | 0.7 | 0.2 | 0.1 | 1.0 | 0.5 | 1.0 |
| Bentonite clay | — | 3.0 | 4.0 | — | — | — |
| Glycerol | 0.1 | 0.1 | — | — | 1.0 | — |
| Dry additives | | | | | | |
| Bentonite clay | — | — | | — | 1.0 | 5.0 |
| Citric acid | — | — | — | — | 2.0 | 3.0 |
| PB4 | — | 3.0 | — | — | — | — |
| PB1 | — | — | 4.0 | 1.0 | — | — |
| Percarbonate | 12.0 | — | — | 1.0 | — | 2.0 |
| Carbonate | — | 5.3 | — | 5.0 | 14.0 | 4.0 |
| DOBS/NOBS | 0.5 | — | 0.4 | 0.3 | — | 0.6 |
| DOBS | — | 0.9 | — | — | 0.3 | — |
| TAED | 0.6 | 0.4 | 0.6 | 0.3 | 0.9 | 0.5 |
| Methyl cellulose | 0.2 | — | — | — | — | 0.5 |
| DTPA | 0.7 | 0.5 | 1.0 | 0.5 | 0.5 | 1.2 |
| Speckle | 0.3 | 0.2 | 2.0 | — | 0.7 | 0.5 |
| SKS-6 | 8.0 | — | — | — | — | — |
| STS | — | — | 2.0 | — | 1.0 | — |
| Perfume including encapsulated perfumes | 0.5 | 1.0 | 2.0 | 0.2 | 1.0 | 2.0 |
| Lipase | 0.2 | — | 0.2 | — | 0.2 | 0.4 |
| Cellulase | 0.2 | 0.2 | 0.2 | 0.3 | 0.2 | 0.2 |
| Amylase II | 0.2 | — | 0.1 | — | 0.2 | — |
| Protease | 0.5 | 0.5 | 0.5 | 0.3 | 0.5 | 0.5 |
| PVPVI | — | — | — | — | 0.5 | 0.1 |
| PVP | — | — | — | — | 0.5 | — |
| PVNO | — | — | 0.5 | 0.3 | — | — |
| QEA | — | — | — | — | 1.0 | — |
| SRP | 0.2 | 0.5 | 0.3 | — | 0.2 | — |
| Silicone | 0.2 | 0.4 | 0.2 | — | 0.1 | — |

-continued

| | E | F | G | H | I | J |
|---|---|---|---|---|---|---|
| antifoam | | | | | | |
| Mg sulfate | — | — | 0.2 | — | 0.2 | — |
| Misc/minors to 100% | | | | | | |

EXAMPLE 3

The following is a composition in the form of a tablet, bar, extrudate or granule in accord with the invention

| | K | L | M | N | O | P | Q |
|---|---|---|---|---|---|---|---|
| Sodium $C_{11}$–$C_{13}$ alkylbenzenesulfonate | 12.0 | 10.0 | 13.0 | 19.0 | 18.0 | — | 6.0 |
| Sodium $C_{14}$–$C_{15}$ alcohol sulfate/MBAS | — | 4.5 | — | — | — | 17.0 | 4.0 |
| $C_{14}$–$C_{15}$ alcohol ethoxylate (3) sulfate | — | — | 2.0 | — | 1.0 | 1.0 | 1.0 |
| Sodium $C_{14}$–$C_{15}$ alcohol ethoxylate | 2.0 | 2.0 | — | — | — | — | 5.0 |
| $C_9$–$C_{14}$ alkyl dimethyl hydroxy ethyl quaternary ammonium salt | | | — | — | 1.0 | 0.5 | 2.0 |
| Tallow fatty acid | 3.0 | 0.6 | 2.0 | — | — | — | 1.0 |
| Tallow alcohol ethoxylate (50 or 80) | 1.0 | — | — | — | — | 0.5 | — |
| Sodium tripoly-phosphate/Zeolite | 23.0 | 25.0 | 14.0 | 22.0 | 20.0 | 10.0 | 20.0 |
| Sodium carbonate | 25.0 | 7.0 | 5.0 | 12.0 | — | 14.0 | — |
| Sodium Polyacrylate (45%) | 0.5 | 0.5 | 0.5 | 0.5 | — | — | — |
| Sodium polyacrylate/maleate polymer | — | — | 1.0 | 1.0 | 1.0 | 2.0 | 0.5 |
| Sodium silicate (1:6 ratio $NaO/SiO_2$) (46%) | 3.0 | — | — | — | — | 6.0 | — |
| Sodium sulfate | — | — | — | — | 2.0 | 2.0 | 3.0 |
| Sodium perborate/ percarbonate | 5.0 | 5.0 | 10.0 | — | 3.0 | 1.0 | — |
| Poly(ethyleneglycol), MW ~4000 (50%) | 1.5 | 1.5 | 1.0 | 1.0 | — | — | 0.5 |
| Sodium carboxy methyl cellulose | 1.0 | 1.0 | 1.0 | — | 0.5 | 0.5 | 0.5 |
| Citric acid | 5.0 | 3.0 | — | 5.0 | 2.0 | — | — |
| NOBS/DOBS | — | 1.0 | — | — | 1.0 | 0.7 | — |
| TAED | 1.5 | 1.0 | 2.5 | — | 3.0 | 0.7 | 4.0 |
| SRP | 1.5 | 1.5 | 1.0 | 1.0 | — | 1.0 | — |
| Clay I or II | 5.0 | 6.0 | 12.0 | 7.0 | 10.0 | 4.0 | 3.0 |
| Bentonite | 4.0 | — | — | — | — | — | 2.0 |
| Flocculating agent I or III | 0.1 | 0.1 | 0.1 | 0.1 | 0.1 | 0.15 | 0.05 |
| Glycerol/silica | 0.5 | 1.0 | 0.5 | 1.0 | 0.5 | 0.5 | 0.5 |
| Wax | 0.5 | 0.5 | 1.0 | — | — | 0.5 | 0.5 |
| Magnesium sulphate | — | — | — | — | — | 0.5 | 1.5 |
| Chelant | — | — | — | — | 0.8 | 0.6 | 1.0 |
| Enzymes, including amylase, cellulase, protease and lipase | — | — | — | — | 2.0 | 1.5 | 2.0 |
| Speckle | 0.5 | 2.0 | 1.2 | 1.4 | 0.6 | — | 0.2 |
| minors, e.g. perfume, PVP, PVPVI/PVNO, brightener, photo-bleach, silicon derivative | 2.0 | 1.0 | 1.0 | 1.0 | 2.5 | 1.5 | 3.0 |

EXAMPLE 4

The following are compositions in the form of a tablet, bar, extrudate or granule in accord with the invention.

| | R | S | T | U |
|---|---|---|---|---|
| Sodium $C_{11}$–$C_{13}$ alkylbenzenesulfonate | 23.0 | 13.0 | 7.0 | 18.0 |
| Sodium $C_{14}$–$C_{15}$ alcohol sulfate | — | 4.0 | — | — |
| Clay I or II | 5.0 | 10.0 | 14.0 | 6.0 |
| Bentonite clay | 2.0 | — | — | — |
| Flocculating agent I or II | 0.2 | 0.3 | 0.2 | 0.05 |
| Wax | 0.5 | 0.5 | 1.0 | — |
| glycerol/silica | 0.5 | — | 1.5 | — |
| $C_{14}$–$C_{15}$ alcohol ethoxylate sulfate | — | | — | 2.0 |
| Sodium $C_{14}$–$C_{15}$ alcohol ethoxylate ( | 2.5 | 3.5 | — | — |
| $C_9$–$C_{14}$ alkyl dimethyl hydroxy ethyl quaternary ammonium salt | 1.0 | — | — | 0.5 |
| Tallow fatty acid | 0.5 | 2.0 | 1.0 | — |
| Tallow alcohol ethoxylate (50) | — | — | | 1.3 |
| Sodium tripolyphosphate | — | 41.0 | — | 20.0 |
| Zeolite A, hydrate (0.1–10 micron size) | 26.3 | — | 21.3 | — |
| Sodium carbonate | 24.0 | 22.0 | 35.0 | 27.0 |
| Sodium Polyacrylate (45%) | 2.4 | — | 2.7 | — |
| Sodium polyacrylate/maleate polymer | — | — | 1.0 | 2.5 |
| Sodium silicate (1.6 or 2 or 2.2 ratio $NaO/SiO_2$)(46%) | 4.0 | 7.0 | 2.0 | 6.0 |
| Sodium sulfate | — | 6.0 | 2.0 | — |
| Sodium perborate/ percarbonate | 8.0 | 4.0 | — | 12.0 |
| Poly(ethyleneglycol), MW ~4000 (50%) | 1.7 | 0.4 | 1.0 | — |
| Sodium carboxy methyl cellulose | 1.0 | — | — | 0.3 |
| Dispensing aids/ effervescence source | 6.0 | 2.0 | 3.0 | 10.0 |
| NOBS/DOBS | 1.2 | — | — | 1.0 |
| TAED | 0.6 | 1.5 | — | 3.0 |
| Perfume | 0.5 | 1.0 | 0.3 | 0.4 |
| SRP | — | 1.5 | 1.0 | 1.0 |
| Magnesium sulphate | — | — | — | 1.0 |
| Chelant | — | — | — | 0.5 |
| speckle | 1.0 | 0.5 | 0.2 | 2.7 |
| Enzymes, including amylase, cellulase, protease and lipase | — | 1.0 | — | 1.5 |
| minors, e.g. brightener, photo-bleach, perfumes and encapsulates | 1.0 | 1.0 | 1.0 | 1.0 |

EXAMPLE 5

The following are compositions is in accord with the invention.

| | V | W | X | Y |
|---|---|---|---|---|
| Clay I or II | 12.0 | 5.0 | 20.0 | 10.0 |
| Fatty acid | 0.3 | — | 1.0 | — |
| Hydrochlorid acid | 0.02 | 0.02 | 0.02 | 0.02 |
| Soil Release Polymer | — | — | 0.02 | 0.02 |
| PEG | — | — | 0.6 | 0.6 |
| Perfume | 1 | 0.5 | 1 | 0.5 |
| Electrolyte | — | — | 600 ppm | 600 ppm |
| Dye | 10 ppm | 10 ppm | 50 ppm | 50 ppm |

-continued

| | V | W | X | Y |
|---|---|---|---|---|
| Flocculant | 0.1 | 0.2 | 0.5 | 0.8 |
| LAS or AS or MBAS | 4.0 | 5.0 | — | — |
| Water and minors to balance to 100% | | | | |

What is claimed is:

1. A detergent composition in solid form, comprising granules which comprise a mixture of a flocculating agent and an organophilic smectite clay whereof at least 30% of the exchangeable cations in the clay are replaced by one or more long-chain organic cations having at least one carbon chain of at least 10 carbon atoms.

2. A detergent composition according to claim 1 wherein the smectite clay is in the form of lath-shaped platelets whereby the ratio of the width to the length of the platelets is at least 1:2.

3. A detergent composition according to claim 1 wherein the organophilic clay is obtained from a saponite, hectorite or montmorillonite clay, or mixtures thereof, whereof at least 40% of the exchangeable cations are replaced with the long-chain organic cation.

4. A composition according to claim 1 wherein the flocculating agent present comprises a polyethylene oxide polymer of an average molecular weight from 150,000 to 3,000,000.

5. A detergent composition according to claim 1 whereby the organophilic smectite clay is present at a level of from 0.5% to 30% by weight of the composition and the ratio of the organophilic smectite clay to the flocculating agent is from 200:1 to 25:1.

6. A detergent composition according to claim 1 whereby the long-chain organic cations comprise one or more organic cations having at least one chain of at least 12 carbon atoms.

7. A detergent composition according to claim 1 whereby the long-chain organic cation or mixtures thereof are selected from quaternary ammonium cations, quaternary immidazolinium cations, quaternary ester cations, comprising one or more cations of the group $C_{12}$–$C_{28}$ dialkyl dimethyl quaternary ammonium, $C_{12}$–$C_{28}$ dialkyl methyl benzyl quaternary ammonium, $C_{12}$–$C_{28}$ dialkyl diethyl quaternary ammoniums, $C_{12}$–$C_{28}$ dialkyl ethyl benzyl quaternary ammonium.

8. A detergent composition according to claim 1 comprising one or more anionic surfactants at a level from 1% to 50% by weight of the composition.

9. A detergent composition according to claim 1 comprising from 0.05% to 5% of a cationic surfactant.

10. A detergent composition according to claim 1 comprising a perfume.

11. A detergent composition according to claim 1 comprising one or more fatty acids.

12. A detergent composition according to claim 1 comprising an additional softening agent selected from the group consisting of nonionic softening agents, additional clay softening agents, silicone derivatives or mixtures thereof.

13. A detergent composition according to claim 1 which is substantially free of non-complexed long-chain organic cations.

* * * * *